US006047860A

United States Patent [19]

Sanders

[11] Patent Number: 6,047,860

[45] Date of Patent: Apr. 11, 2000

[54] CONTAINER SYSTEM FOR PRESSURIZED FLUIDS

[75] Inventor: Stan A. Sanders, Hermosa Beach, Calif.

[73] Assignee: Sanders Technology, Inc., Manhatton Beach, Calif.

[21] Appl. No.: 09/097,142

[22] Filed: Jun. 12, 1998

[51] Int. Cl.[7] ..... B67D 7/60

[52] U.S. Cl. ..... 222/3; 222/6; 222/206

[58] Field of Search ..... 222/3, 6, 206, 222/209, 214, 215

[56] References Cited

U.S. PATENT DOCUMENTS

| | | | |
|---|---|---|---|
| 2,106,494 | 1/1938 | Debor . | |
| 2,106,495 | 1/1938 | Debor . | |
| 2,148,234 | 2/1939 | Debor . | |
| 2,171,972 | 9/1939 | Debor . | |
| 2,171,973 | 9/1939 | Debor . | |
| 2,222,762 | 11/1940 | Debor . | |
| 2,380,372 | 7/1945 | Alderfer . | |
| 2,962,195 | 11/1960 | Greenlee . | |
| 3,338,238 | 8/1967 | Warncke . | |
| 3,440,118 | 4/1969 | Obeda | 156/73 |
| 3,491,752 | 1/1970 | Cowley . | |
| 3,601,128 | 8/1971 | Hakim . | |
| 4,000,760 | 1/1977 | Heller, Jr. . | |
| 4,153,079 | 5/1979 | Ambrose . | |
| 4,484,698 | 11/1984 | Starr | 222/131 |
| 4,932,403 | 6/1990 | Scholley . | |
| 4,932,546 | 6/1990 | Stannard . | |
| 5,036,845 | 8/1991 | Scholley . | |
| 5,127,399 | 7/1992 | Scholley . | |
| 5,135,497 | 8/1992 | Hessel et al. | 604/132 |
| 5,427,155 | 6/1995 | Williams . | |
| 5,466,322 | 11/1995 | Munsch | 156/723 |
| 5,499,739 | 3/1996 | Greist | 220/589 |
| 5,653,358 | 8/1997 | Sneddon | 220/465 |
| 5,704,512 | 1/1998 | Falik . | |

FOREIGN PATENT DOCUMENTS

| | | |
|---|---|---|
| 695372 | of 1964 | Canada . |
| 651616 | of 1937 | Germany . |
| 658447 | of 1938 | Germany . |
| 1253054 | of 1967 | Germany . |
| 2305840 | of 1974 | Germany . |
| 1100876 | of 1968 | United Kingdom . |
| 2204390 | of 1988 | United Kingdom . |

*Primary Examiner*—Steven O. Douglas
*Attorney, Agent, or Firm*—Fulwider Patton Lee & Utecht LLP

[57] ABSTRACT

A container system for pressurized fluids that includes a plurality of generally ellipsoidal chambers connected by a tubular core. The tubular core is formed along its length with a plurality of apertures each of which is positioned within one of the chambers. The apertures are of comparatively small size so as to be able to control the rate of evacuation of pressurized fluid should a chamber be ruptured.

9 Claims, 6 Drawing Sheets

CONTAINER SYSTEM FOR PRESSURIZED FLUIDS

FIELD OF THE INVENTION

The present invention relates to containers for containing high-pressure fluids and is directed to an inexpensive, light, compact, flexible and safe container for pressurized fluids which is resistant to explosive rupturing.

BACKGROUND OF THE INVENTION

Containers presently used for the storage and use of compressed fluids and particularly gasses, generally take the form of cylindrical metal bottles wound with reinforcing materials to withstand high fluid pressures. Such storage units are expensive to manufacture, inherently heavy, bulky, inflexible and prone to fragmentation that can lead to explosions. Such containers are commonly used to store oxygen. By way of example, the medical use of compressed oxygen for ambulatory patients is growing rapidly. As another example, portable metal tank containers are carried by fire fighters at the scene of a fire to provide emergency air. Synthetic plastic containers for pressurized fluids are also presently utilized, however, existing containers of this type do not provide sufficient bursting strength where high fluid pressures are encountered.

SUMMARY OF THE INVENTION

The container system for pressurized fluids embodying the present invention overcomes the aforementioned problems inherent to prior art pressurized fluid container systems.

More particularly, the container system for pressurized fluids embodying the present invention includes a plurality of form-retaining, generally ellipsoidal chambers having open ends through which coaxially extends a tubular core which is sealingly secured within the ends of the chambers. The core serves to support the ellipsoidal chambers along the length of the core. The core is formed with apertures along its length, with one of such apertures being positioned within the confines of each ellipsoidal chamber so as to be in fluid-transfer communication with the interior of the ellipsoidal chambers. The apertures are of comparatively small size so as to be able to control the rate of evacuation of pressurized fluid from the ellipsoidal chambers. Accordingly, if one or more of the ellipsoidal chambers are punctured, the pressurized fluid contained therewithin must escape from all of the chambers through the core apertures, thus causing the pressurized fluid to maintain its inertia of internal mass because of the resistance provided by the comparatively small apertures. A very low fluid evacuation rate is thereby effected so as to avoid a large and potentially dangerous burst of energy.

The fluid container system of the present invention utilizes a plurality of the aforementioned ellipsoidal chambers which are connected by a common tubular core with the core supporting a desired number of ellipsoidal chambers within a protective housing. Preferably, the ellipsoidal chambers will be disposed in parallel rows within the housing, with the tubular core being curved so as to interconnect the upper and lower ends of such rows. One end of the tubular core is connected to a fluid inlet while the other end of the core is connected to a fluid outlet supported by the housing. Applications for such containers include portable oxygen back-packs, home oxygen bottles, lightweight welder bottles and compressed air operated tool back-packs. Such containers may also be utilized as replacement fuel tanks on aircraft, boats and automotive vehicles, particularly since the containers can be shaped for storage in desired locations. In the event of a sharp impact, the fuel containers would not explode as often happens with conventional single chamber fuel containers.

The present invention also provides a method and apparatus for forming ellipsoidal chamber and tubular core assemblies so as to enable the aforementioned pressurized fluid container system to be manufactured at low production cost, particularly as compared as to conventional fiber wound metal cylinders used to contain oxygen and other gasses at high pressures.

These and other objects and advantages of the present invention will become apparent from the following detailed description when taken in conjunction with the accompanying drawings.

DETAILED DESCRIPTION OF PREFERRED EMBODIMENTS

Figure 1:
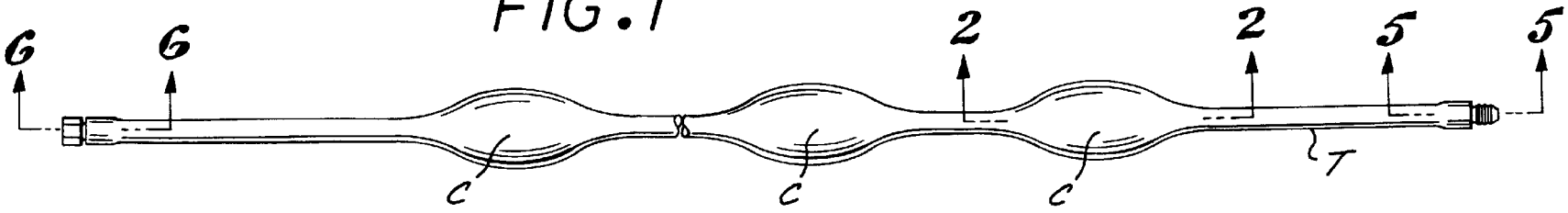
FIG. 1 is a broken side elevational view of a plurality of aligned rigid generally ellipsoidal chambers interconnected by a tubular core embodying the present invention.

Referring to the drawings, particularly FIGS. 1–6 thereof, a container system for pressurized fluids embodying the present invention includes a plurality of assemblies of form-retaining generally ellipsoidal chambers C and a tubular core T. Tubular core T is coaxial to and sealingly secured to the chambers C. The tubular core T is formed along its length with a plurality of longitudinally equal distantly spaced apertures A which are in fluid-transfer communication with the interior 20 of each chamber C. The size of the apertures A are pre-selected so as to control the rate of evacuation of pressurized fluid from chambers C. In this manner, a very low fluid evacuation rate can be effected so as to avoid a large and potentially dangerous large burst of energy should one or more of the chambers C be punctured.

Figure 2:
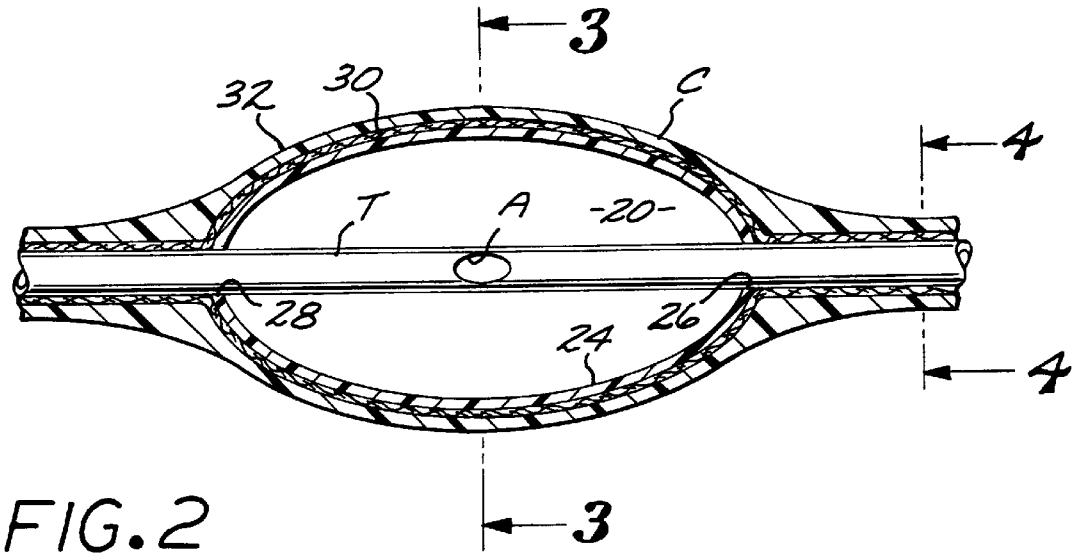
FIG. 2 is an enlarged horizontal sectional view taken along line 2—2 of FIG. 1.
Figure 3:
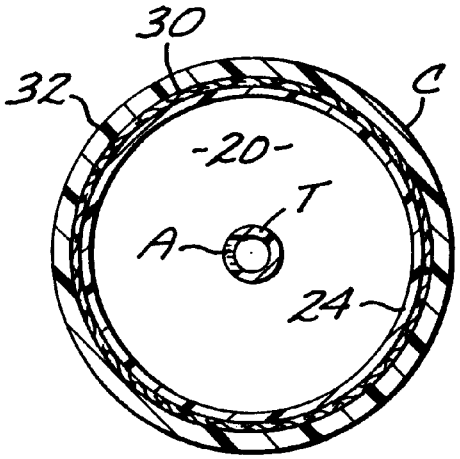
FIG. 3 is a vertical sectional view of an ellipsoidal chamber and tubular core taken along line 3—3 of FIG. 2.
Figure 4:
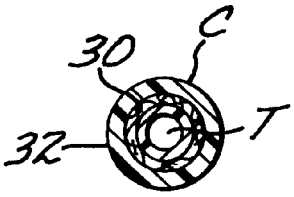
FIG. 4 is a vertical sectional view taken along 4—4 of FIG. 2.

Referring to FIGS. 2 and 3, each chamber C includes a generally ellipsoidal shell 24 molded of a suitable synthetic plastic material and having open front and rear ends 26 and 28. The diameters of the holes 26 and 28 are dimensioned so as to snugly receive the outside diameter of the tubular core T. The tubular core T is sonically welded to the shells 24 so as to form a fluid tight seal therebetween. The exterior of the shells 24 and the increments of tubular core T between such shells are pressure wrapped with suitable pressure resistant reinforcing filaments 30 to resist bursting of the shells and tubular core. A protective synthetic plastic coating 32 is applied to the exterior of the filament wrapped shells and tubular core T.

More particularly, the shells 24 may be either roto molded, blow molded, or injection molded of a synthetic plastic material such as TEFLON or fluorinated ethylene propylene. Preferably, the tubular core T will be formed of the same material. The pressure resistant filaments 30 maybe made of a carbon fiber, Kevlon or Nylon. The protective coating 32 may be made of urethane to protect the chambers and tubular core against abrasions, UV rays, or thermal elements. The assembly of a plurality of generally ellipsoidal chambers C and their supporting tubular core T can be made in desired lengths such as 10 to 20 feet. The size of the apertures A will depend upon various parameters, such as the volume and viscosity of fluid being contained, the anticipated pressure range, and the desired flow rate. In general, smaller diameters will be selected for gasses as composed to liquids. Thus, the aperture size may generally vary from about 0.010 to 0.125 inches.

Figure 5:
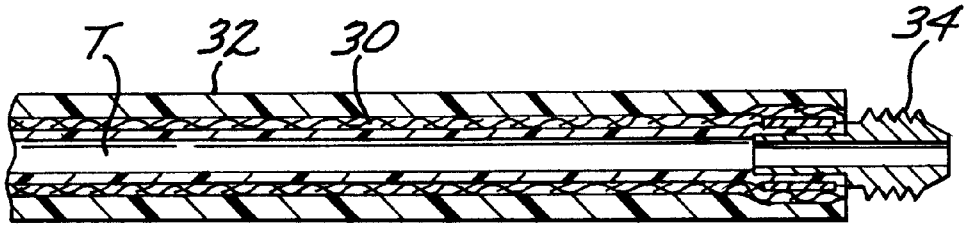
FIG. 5 is a horizontal sectional view taken in enlarged scale along line 5—5 of FIG. 1.
Figure 6:
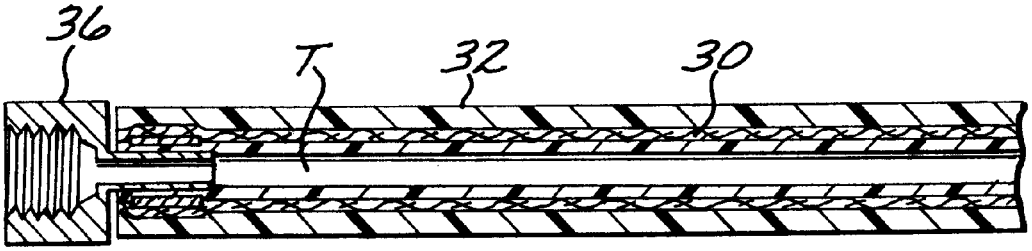
FIG. 6 is a horizontal sectional view taken in enlarged scale along line 6—6 of FIG. 1.

Referring to FIG. 5, the inlet or front end of the tubular core T is provided with a suitable conventional threaded male fitting 34. The discharge or rear end of a tubular core T is provided with a conventional threaded female fitting 36. Such male and female fittings provide a pressure-type connection between contiguous lengths of tubular cores T.

Figure 7:
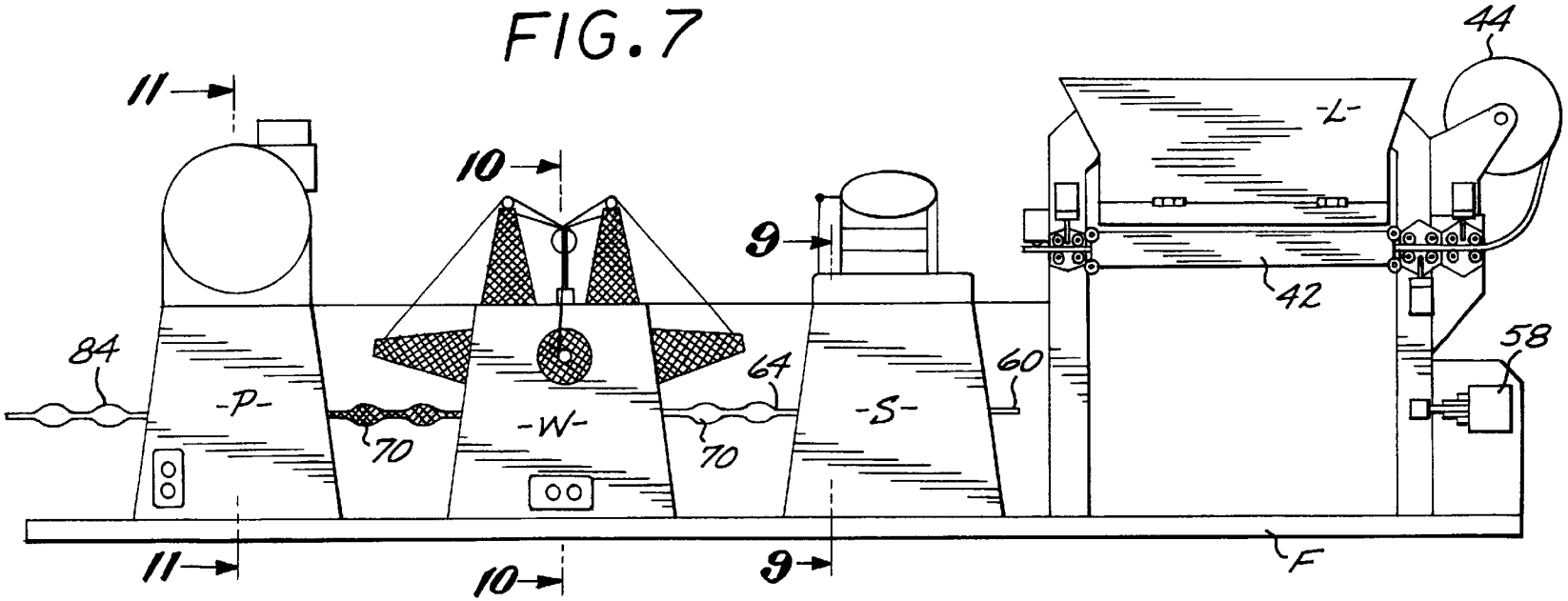
FIG. 7 is a side elevational view of apparatus which may be employed with the method of the present invention for making the generally ellipsoid chamber and tubular core assembly shown in FIGS. 1–6.
Figure 7A:
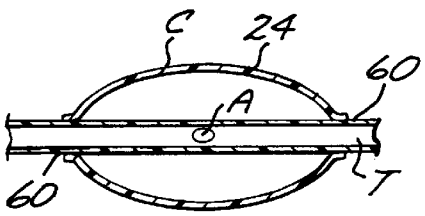
FIG. 7A shown a first step in making an ellipsoidal chamber and tubular core assembly.
Figure 7B:
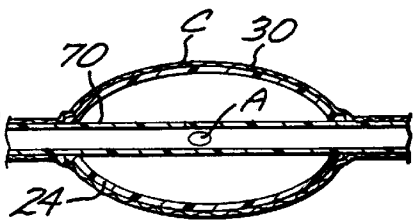
FIG. 7B shows a second step in making such assembly.
Figure 7C:
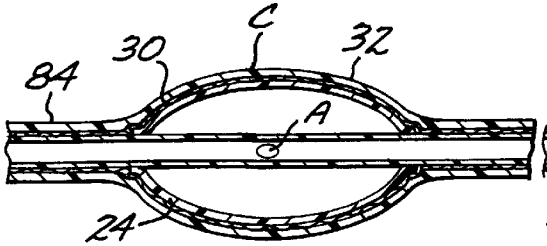
FIG. 7C is a broken sectional view showing a third step in making such assembly.

Referring now to FIGS. 7–11, there is shown a preferred form of apparatus which may be employed to carry out the method of the present invention for making the assembly of generally ellipsoid chambers C and tubular core T shown in FIGS. 1–6. Referring to FIG. 7, such apparatus includes a frame F upon which are mounted in aligned relationship, commencing with the right-hand end of FIG. 7, a chamber shell loader L, a sonic welder S disposed to the left thereof, a filament winder W, disposed to the left of the sonic welder S and a plastic coater P disposed to the left of the filament winder F. The chamber shell loader L is shown in greater detail in FIG. 8. Referring thereto such loader includes posts 38 and 39 having their lower ends affixed to the base 40 of frame F and with their upper ends supporting supply bin 41 below which is disposed a shell transfer tray 42. The transfer tray 42 is vertically movably supported on the posts by rollers 43 for movement between a first, raised loading position below the loader shown in FIG. 7 and FIG. 8 in solid outline and a second, lower unloading position shown in dotted outline in FIG. 8. The upper portion of post 39 supports a spool 44 which carries a coiled supply of tubular core material T. The tubular core material is moved through the transfer tray 42 by conventional power-operated pusher roller units 46 and 47 arranged on right-hand post 39 and a conventional power-operated puller roller unit 48 arranged at the upper portion left-hand post 38. A conventional power-operated hole puncher 50 is disposed above the pusher roller unit 47. A first conventional power-operated rear tubular core cutter 52 is positioned above the pusher roller unit 46 and a like second front tubular core cutter 54 is positioned above the puller roller unit 48. A conventional electrically operated counter and control box 56 is carried by left-hand post 38 adjacent puller roller unit 48. A conventional hydraulically-operated pusher ram unit 58 is carried by post 39 in horizontal alignment with the unloading position of shell transfer tray 42.

Figure 8:
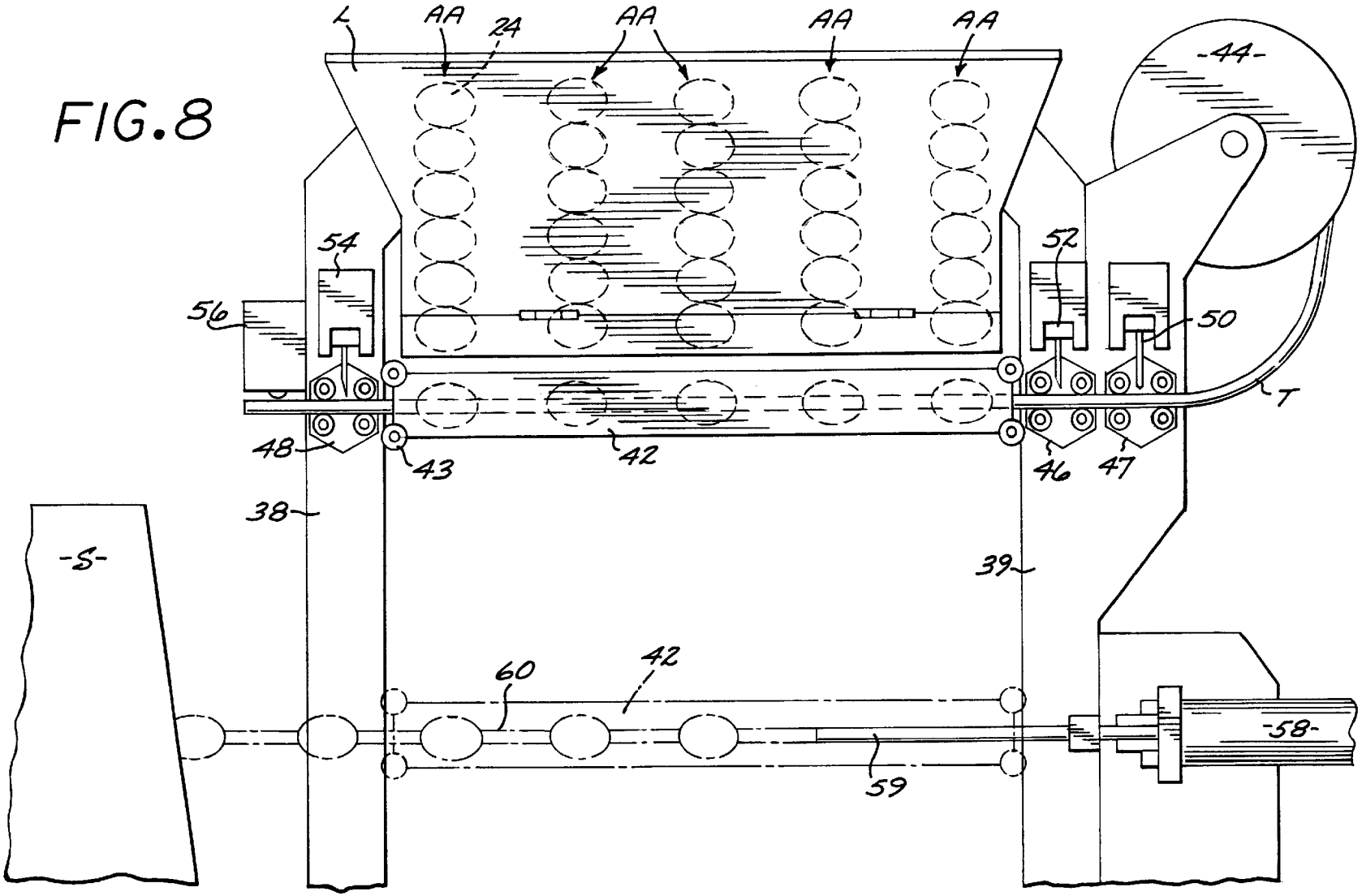
FIG. 8 is a schematic side elevational view of a machine employed in the fabrication of the ellipsoidal chamber and tubular core assembly embodying the present invention.

In the operation of the shell loader L a plurality of horizontally and vertically aligned arrays AA of the shells 24 are supported within the bin 41 of shell transfer tray 42 at horizontally equidistant positions, as shown in dotted outline in FIG. 8. The horizontally aligned arrays of shells 24 subsequently fall out of bin 41 in single horizontal rows into the upper open end of transfer tray 42 and are temporarily held by suitable conventional means (not shown) in coaxial, horizontal alignment to receive a first increment of tubular core material T from the supply roll 44 while the transfer tray is disposed in its raised shell loading position. A first length of tubular core material T is sequentially urged horizontally through the transfer tray 42 so as to be inserted within the open ends of the shells 24 with a retention fit. During such movement of the tubular core material through the shells, the hole puncher 50 will sequentially form the apertures A at longitudinally equidistant locations on the tubular core corresponding to approximately the center of the individual shells 24. With the tubular core material snugly received within the open ends of shells 24 the rear cutter 52 will sever the portion of tubular core disposed adjacent the entrance end of tray 42, while the front cutter 54 will sever the portion of the tubular core adjacent the exit end of the tray 42. The tray 42 and the assembly 55 of tubular core T-l and shells 24 contained therewithin is then lowered to the dotted outline shell ejection position of FIG. 8, with the tubular core in coaxial alignment with the plunger 59 of the hydraulic ram. The hydraulic ram plunger 59 will then force the first shell and tubular core assembly 60 out of the tray towards and into the sonic welder S. The tray 42 will then be returned upwardly to its original solid outline position of FIG. 8 to receive the next array AA of chamber shells 24 and tubular core material T. It should be understood that suitable conventional power-actuated control means are incorporated in the chamber shell loader L to effect the above-described operation of the parts thereof.

Figure 9:
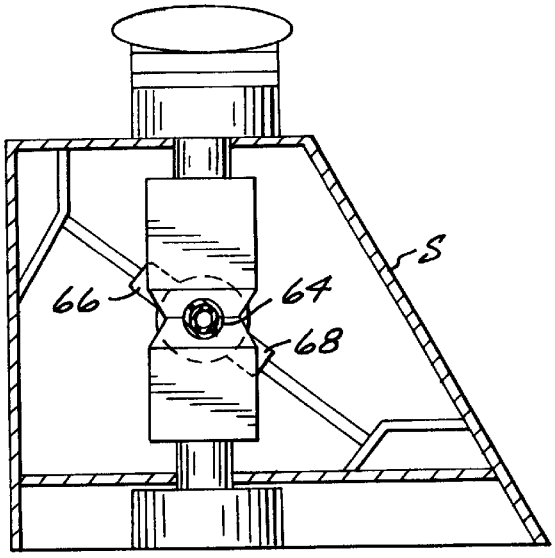
FIG. 9 is a vertical sectional view taken in enlarged scale along line 9—9 of FIG. 7 showing an ellipsoidal chamber being sonically welded to a tubular core.
Figure 10:
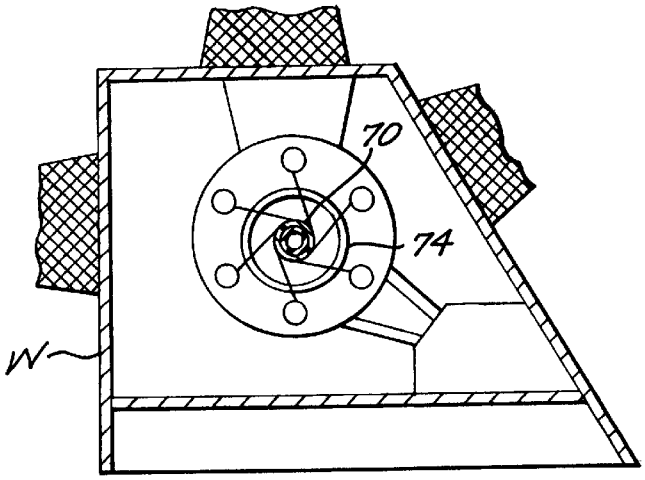
FIG. 10 is a vertical sectional view taken in enlarged scale along line 10—10 in FIG. 7 showing a filament winding step of the method of making the ellipsoid chamber and tubular core assembly.
Figure 11:
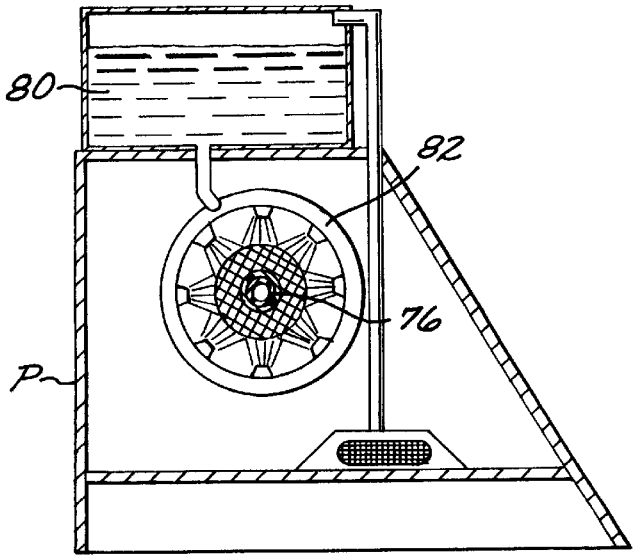
FIG. 11 is a side elevational view taken in enlarged scale along line 11—11 in FIG. 7 showing an ellipsoidal chamber and tubular core being coated with a hot protective synthetic plastic coating in accordance with the present invention.
Figure 12:
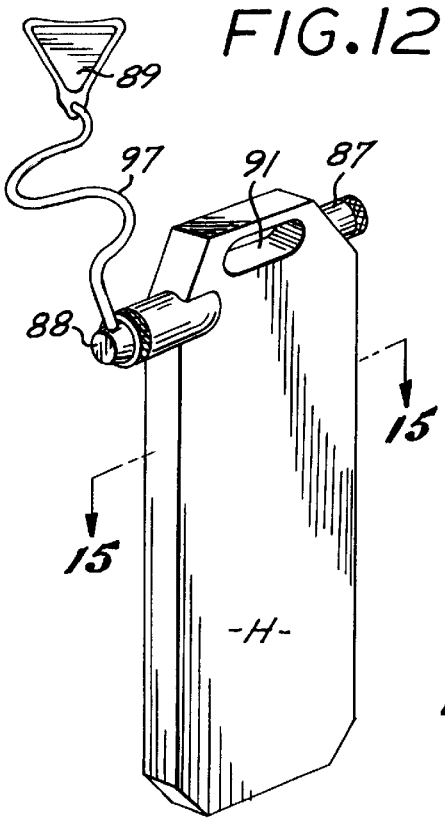
FIG. 12 is a perspective view of a housing for a plurality of the ellipsoidal chambers and tubular core assemblies of the present invention.
Figure 13:
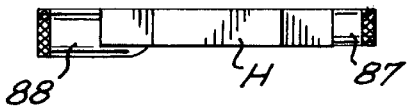
FIG. 13 is a top plan view of the housing of FIG. 11.
Figure 15:
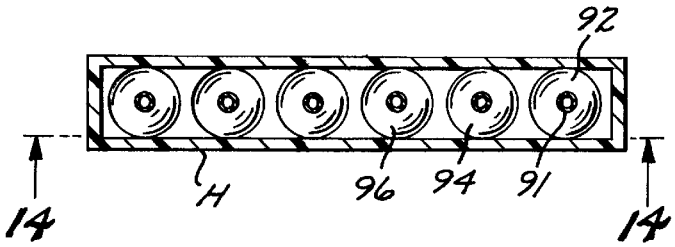
FIG. 15 is a vertical sectional view taken in enlarged scale along line 15—15 of FIG. 12.
Figure 14:
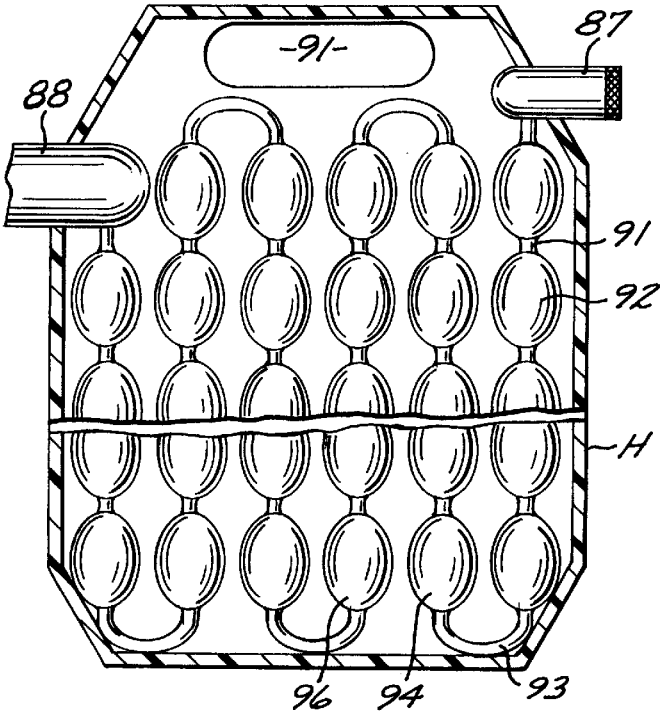
FIG. 14 is a broken side elevational view of the housing of FIG. 12 taken along line 14–15 of FIG. 15.

As the first shell and tubular core assembly 60 is urged out of the tray 42 by hydraulic ram plunger 59, the left-hand or front end of the tubular core of such first assembly 60 will abut the right-hand or rear end of the shell and tubing core assembly 64 to force such assembly into sonic welder S in FIG. 9. The conventional sonic welder S includes fusion horns 66 and 68 which serve to effect fusion of the tubular core T to the generally ellipsoidal shaped shells 24. Movement of the shell and tubular core assembly 64 into the sonic welder S by plunger 59 will cause the left-hand or front end of the tubular core of such assembly to force the adjacent shell and tubular core assembly 70 into the conventional filament winder W. As shown in FIG. 10, the conventional filament winder W includes a rotatable spool 72 which effects high-speed wrapping of reinforcement filaments 74 over the exterior surfaces of the shells 24 and tubular core T. It should be noted that the use of generally ellipsoidal shells 24 permits even coverage of the filaments over the entire surface area of the shells and the tubular core C between the shell. Maximum bursting resistance is thereby achieved. At the completion of the filament winding step, the assembly of shells 24 and tubular core T are pushed to the left out of the filament winder W into the confines of the conventional plastic coater P. As indicated in FIG. 11, the plastic coater P is provided with a tank 80 containing a suitable synthetic plastic such as TEFLON or fluorinated ethylene propylene. The tank 80 is connected to a spray nozzle member 82, which as indicated in FIG. 11, serves to coat the exterior surfaces of the filament-wound shells and tubular core assembly 76 with a protective coating. The completed shell and tubular core assembly 84 is then urged out of plastic coater P by the shell and tubular core assembly 76 during the next stroke of hydraulic ram plunger 59.

Referring now to FIGS. 12–15, there is shown an exemplar of a container system for pressurized fluids embodying the present invention. In these figures, such container system take the form of a pressurized gas pack having a housing H provided with an inlet fitting 87 and a discharge fitting 88. The discharge fitting 88 is connected to a conventional mask 89. More particularly, the housing H may be fabricated of a suitable non-flammable material such as a carbon fiber, polyethylene, synthetic plastic foam or cast into a dense block of synthetic foam rubber. Housing H is formed at its upper portion with a carrying handle 90. Conventional inlet fitting 87 is attached to one side of housing H in communication with the upper end of a tubular core element 91 of a first row 92 of vertically disposed generally ellipsoidal chambers and tubular core assemblies made in accordance with the aforedescribed method. The lower end of the tubular core element 91 is formed with a reverse curve section 93 and then extends upwardly through a second row 94 of generally ellipsoidal chamber and tubular core assemblies. The upper end of the tubular core element of the second row 94 is in turn formed with a reverse curve and extends downwardly through a third row 96 of generally ellipsoidal chambers. Additional assemblies are similarly arranged within the housing H. The upper end of the tubular core of the last row of assemblies is in communication with the conventional discharge fitting 88, attached to the left-hand side of the housing. Such discharge fitting 88 is in turn fitted to a flexible hose 97 connected to mask 89. The aforedescribed pack can be made lighter and more compact than conventional packs of this nature, and can serve as a regulatory device containing air, oxygen, nitrogen or other gasses.

From the foregoing description it will be understood that the container system for pressurized fluids embodying the present invention provides important advantages over existing fluid container systems. By way of example, should one or more of the chambers C be ruptured, only the pressurized fluid disposed within such chambers would undergo a sudden release. The pressurized fluid disposed in the other chambers could only escape into the atmosphere at a safe controlled rate because of the throttling effect of the apertures A.

While a particular form of the invention has been illustrated and described, it will also be apparent to those skilled in the art that various modifications can be made without departing from the spirit and scope of the invention. Accordingly, it is not intended that the invention be limited except by the appended claims.

What is claimed is:

1. A pack for pressurized gas, comprising:

a housing;

an inlet fitting attached to the housing;

a discharge fitting attached to the housing;

a plurality of rows of form-retaining generally ellipsoidal chambers connected together by a tubular core;

gas evacuation rate controlling apertures formed in the tubular core, each aperture being disposed within one of the chambers; and one end of the tubular core being in communication with the inlet fitting and the opposite end of the tubular chamber being in communication with the discharge fitting.

2. A container system for pressurized fluids, said container system including:

a plurality of longitudinally separated, form-retaining generally ellipsoidal chambers;

a tubular core coaxial with and sealingly secured to the chambers along the length of the core; and apertures formed along the length of the tubular core at substantially the mid-portion of each chamber to be in fluid-transfer communication with the interiors of the chambers, and with the size of such apertures controlling the rate of evacuation of fluid from the chambers.

3. A container system for pressurized fluids, said container system including:

a plurality of longitudinally separated, form-retaining generally ellipsoidal chambers;

a tubular core coaxial with and sealingly secured to the chambers along the length of the core;

apertures formed along the length of the tubular core within the chambers to be in fluid-transfer communication with the interiors of the chambers, and with the size of such apertures controlling the rate of evacuation of fluid from the chambers; and wherein the chambers are each defined by a generally ellipsoidal synthetic plastic shell having open ends which sealingly and rigidly receive the tubular core.

4. A container system as set forth in claim 3 wherein a tubular core aperture is positioned at substantially the mid-portion of each chamber.

5. A container system as set forth in claim 3 wherein reinforcing filaments are wrapped about the shells and the portions of the tubular core exterior of the chambers.

6. A container system as set forth in claim 5 wherein a tubular core aperture is positioned at substantially the mid-portion of each chamber.

7. A container system as set forth in claim 5 wherein the tubular core is formed of synthetic plastic material and the tubular core and shells are sonically welded together.

8. A container system for pressurized fluids, said container system including:

a plurality of longitudinally separated, form-retaining generally ellipsoidal chambers;

the chambers each being defined by a generally ellipsoidal synthetic plastic shell having open ends;

a synthetic plastic tubular core coaxial with and sonically welded to the shells along the length of the core;

apertures formed along the length of the tubular core within the chambers to be in fluid-transfer communication with the interiors of the chambers, and with the size of such apertures controlling the rate of evacuation of fluid from the chambers;

reinforcing filaments wrapped about the shells and the portions of the tubular core exterior of the chambers; and a synthetic plastic protective coating covering the filaments.

9. A container system as set forth in claim 8 wherein a tubular core aperture is positioned at substantially the mid-portion of each chamber.

* * * * *